US005943749A

United States Patent [19]

Swank

[11] Patent Number: 5,943,749

[45] Date of Patent: Aug. 31, 1999

[54] METHOD OF MANUFACTURING A HOLLOW POINT BULLET

[75] Inventor: Brian Eugene Swank, Marengo, Ohio

[73] Assignee: The Nippert Company, Delaware, Ohio

[21] Appl. No.: 08/963,752

[22] Filed: Nov. 4, 1997

[51] Int. Cl.[6] ..... B21K 21/06

[52] U.S. Cl. ..... 29/1.22; 102/509

[58] Field of Search ..... 102/501, 507–510, 102/439; 29/1.2–1.23

[56] References Cited

U.S. PATENT DOCUMENTS

| | | | |
|---|---|---|---|
| 90,732 | 6/1869 | Curtis . | |
| 219,840 | 9/1879 | Winchester . | |
| 2,045,964 | 6/1936 | Rinkel | 102/509 |
| 3,069,748 | 12/1962 | Nobler . | |
| 3,157,137 | 11/1964 | Burns, Jr. | 102/509 |
| 3,881,421 | 5/1975 | Burczynski . | |
| 4,550,662 | 11/1985 | Burczynski . | |
| 4,655,140 | 4/1987 | Schirneker | 102/508 |
| 4,716,834 | 1/1988 | Wallow et al. . | |
| 4,836,110 | 6/1989 | Burczynski . | |
| 4,882,822 | 11/1989 | Burczynski . | |
| 4,947,755 | 8/1990 | Burczynski . | |
| 5,131,123 | 7/1992 | Brooks . | |
| 5,208,424 | 5/1993 | Schluckebier et al. | 102/509 |
| 5,259,320 | 11/1993 | Brooks . | |
| 5,339,743 | 8/1994 | Scarlata | 102/509 |
| 5,357,866 | 10/1994 | Schluckebier et al. . | |
| 5,811,723 | 9/1998 | Stone | 102/509 |

FOREIGN PATENT DOCUMENTS

| | | | |
|---|---|---|---|
| 80057 | 3/1868 | France | 102/501 |
| 3822775 | 2/1990 | Germany | 102/507 |
| 3840165 | 7/1990 | Germany | 102/510 |
| 2530 | of 1866 | United Kingdom | 102/501 |

*Primary Examiner*—Harold J. Tudor
*Attorney, Agent, or Firm*—Killworth, Gottman, Hagan & Schaeff, L.L.P.

[57] ABSTRACT

A method of manufacturing a hollow point bullet is disclosed. A cavity is formed in an end portion of a slug of generally solid material. A plurality of grooves are formed on an outer surface of the end portion of the slug. A slit is cut through a portion of each of the grooves substantially adjacent a peripheral edge of the end portion. The end portion of the slug is contoured so that the bullet has a desired shape and geometry.

20 Claims, 8 Drawing Sheets

METHOD OF MANUFACTURING A HOLLOW POINT BULLET

BACKGROUND OF THE INVENTION

The present invention relates in general to hollow point bullets, and, more particularly, to a method of manufacturing a hollow point bullet.

The nose portion of a hollow point bullet expands upon impact with a target media thereby increasing the energy transfer capabilities of the bullet. Typically, this expansion results in a number of petals of metal being formed as the nose portion folds back upon itself, thereby increasing the effective diameter of the bullet. This expansion and resultant petal formation is referred to as "mushrooming." A hollow point bullet may be solid or jacketed. A solid bullet typically comprises a solid piece of metal, such as lead or copper. A jacketed bullet typically comprises a lead core surrounded by a harder metal, such as brass. The jacket is relatively hard and slick, compared to the lead of the core, so the bullet is more resistant to mechanical deformation by the action of the gun as compared to the solid bullet.

One such jacketed hollow point bullet is disclosed by Schluckebier in U.S. Pat. No. 5,357,866. The bullet comprises a lead core and brass jacket which terminates at the edge of the opening in the core forming the hollow point. The bullet comprises a plurality of slits through the core and jacket to facilitate mushrooming upon impact. While the slits facilitate mushrooming, the degree and extent of such mushrooming is limited as a sufficient amount of energy is required to cause the petals to tear through the metal past the slits. Further, one or more of the petals may break off after impact, thereby reducing the weight and effectiveness of the bullet. Another disadvantage to such a bullet is that it is relatively expensive to manufacture.

A solid hollow point bullet is disclosed by Brooks in U.S. Pat. No. 5,259,320. The bullet is formed of solid piece of copper. A shaped cavity is formed in the bullet through extrusion. While the bullet does not include any slits to facilitate mushrooming, the shaped cavity forms alternating areas of weakness for mushrooming upon impact. However, more energy is required to cause the bullet to mushroom as compared to a bullet with slits. Such a bullet also requires a number of punching operations in order to form the cavity in the desired configuration. Further, the punches used to form the cavity tend to wear out quickly thereby increasing the production and manufacturing costs of the bullet.

Accordingly, there is a need for a method of manufacturing a hollow point bullet which is inexpensive and which includes fewer processing steps than the prior art.

SUMMARY OF THE INVENTION

The present invention meets this need by providing a method for manufacturing a hollow point bullet by forming cavity in an end portion of a slug of material. A plurality of grooves are formed on the exterior surface of the end portion. A slit is formed in each of the grooves around a peripheral edge of the end portion. The end portion is contoured so that the bullet has the desired shape.

According to a first aspect of the present invention, a method of manufacturing a bullet comprises providing a slug of generally solid material having an outer surface and an end portion having a cavity therein. A plurality of grooves are formed on the outer surface of the end portion. The end portion of the slug is contoured so that the bullet has a predetermined shape. A plurality of slits may be formed through at least a portion of each of the plurality of grooves. Preferably, the plurality of grooves and slits are formed substantially simultaneously. The slits are formed around a peripheral edge of the end portion of the slug. A plurality of projections which extend into the cavity substantially adjacent corresponding ones of the slits may be formed as the slits are formed. Each of the slits may be formed at an angle of a predetermined number of degrees greater than zero degrees with respect to a longitudinal axis of the slug to thereby form each of the projections.

Preferably, the cavity in the end portion has a truncated cone geometry. The cavity may be formed by forming a portion of the cavity in the end portion in a first forming station and then shaping the cavity in a second forming station to form a truncated cone geometry in the end portion. A diameter of a base portion of the slug may be increased in a third forming station, thereby to form a ridge on the outer surface of the slug between the base portion and the end portion. Preferably, each of the plurality of grooves are formed simultaneously. The method may further comprise the step of annealing the slug.

According to another aspect of the present invention, a method of manufacturing a bullet comprises providing a roll of generally solid wire stock. The roll of wire stock is cut to a predetermined length, forming a slug having an outer surface, a base portion and an end portion terminating in an end face. A cavity is formed in the end portion of the slug through the end face with the cavity forming a peripheral edge along the end face. A plurality of grooves are formed on the outer surface of the slug extending from the peripheral edge of the end portion towards the base portion. One of a plurality of slits is formed through at least a portion of each of the plurality of grooves along the peripheral edge. The end portion of the slug is contoured so that the bullet has a predetermined shape. Preferably, the plurality of grooves and slits are formed substantially simultaneously. A plurality of projections which extend into the cavity substantially adjacent corresponding ones of the slits are formed as the slits are cut. Preferably, the projections are formed by cutting the slits at a predetermined number of degrees greater than zero with respect to a longitudinal axis of the slug. Preferably, the cavity in the end portion has a truncated cone geometry. A diameter of the base portion may be increased, thereby forming a ridge on the outer surface of the slug between the base portion and the end portion. Preferably, each of the plurality of grooves are formed simultaneously.

According to yet another aspect of the present invention, a method of manufacturing a bullet comprises providing a roll of generally solid wire stock. The roll of wire stock is cut to a predetermined length thereby forming a slug having an outer surface, a base portion and an end portion terminating in an end face. A portion of a cavity is formed in the end portion through the end face in a first forming station. The portion of cavity is shaped in a second forming station such that the cavity has a truncated cone shape in the end portion. A diameter of the base portion is increased in a third forming station, thereby forming a ridge on the outer surface between the base portion and the end portion. In a fourth forming station, a plurality of grooves are formed on the outer surface of the slug, extending a predetermined distance from the peripheral edge towards the base portion. Each of a plurality of slits is formed through at least a portion of a respective one of the plurality of grooves along the peripheral edge in the fourth forming station. The end portion of the slug is contoured in a fifth forming station so that the bullet has a predetermined shape. The plurality of grooves are formed simultaneously by scoring the outer surface of the slug against a scoring element having a plurality of scoring fingers corresponding to the plurality of grooves. Preferably, all of the slits are formed simultaneously by cutting the end portion of the slug using a cutting element positioned substantially adjacent the scoring element and having a plurality of cutting fingers aligned with each of the scoring fingers of the scoring element.

Accordingly, it is an object of the present invention to provide a method of manufacturing a hollow point bullet which is inexpensive and which includes fewer processing steps than prior art methods. Other features and advantages of the invention will be apparent from the following description, the accompanying drawings and the appended claims.

BRIEF DESCRIPTION OF THE DRAWINGS

FIGS. 5A–10A illustrate various manufacturing steps for manufacturing the bullet of FIG. 1 according to the present invention; and FIGS. 5B–10B are sectioned isometric views of the bullet after each of the manufacturing steps illustrated in FIGS. 5A–10A.

DETAILED DESCRIPTION OF THE PREFERRED EMBODIMENTS

Figure 1:
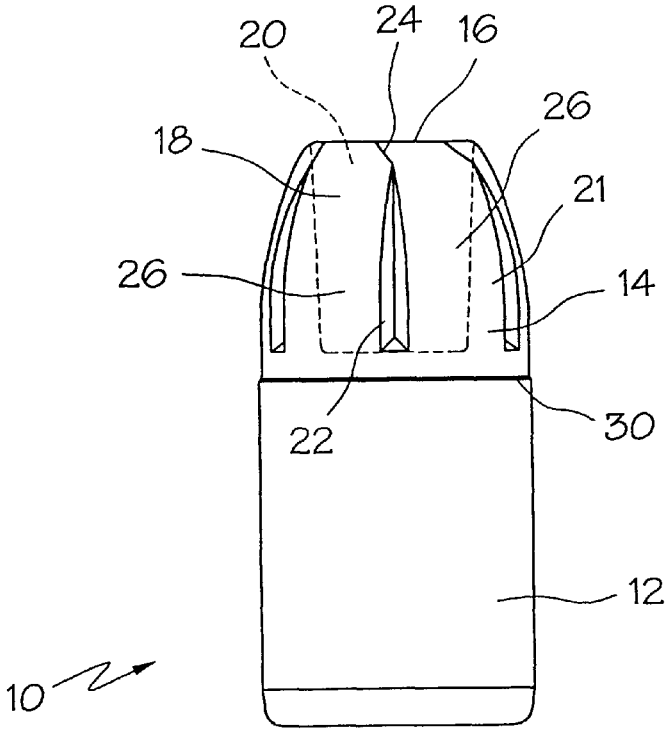
FIG. 1 is a side view of a hollow point bullet manufactured according to the present invention.
Figure 2:
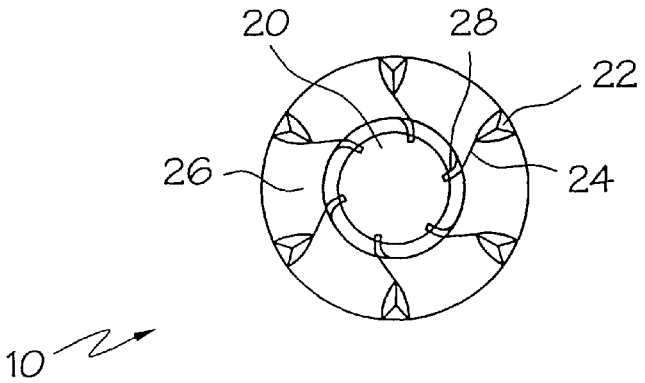
FIG. 2 is a plan view of the hollow point bullet of FIG. 1.

Referring now to FIGS. 1 and 2, a hollow point bullet 10 comprises a base portion 12 and an end portion 14. The end portion 14 of the bullet 10 terminates in a peripheral edge 16 with a wall 18 surrounding a hollow point or cavity 20. An outer surface 21 of the end portion 14 includes a plurality of grooves 22 formed in the wall 18. The grooves 22 extended from the peripheral edge 16 towards the base portion 12 a predetermined distance. In the illustrated embodiment, the predetermined distance is approximately the depth of the cavity 20. A slit 24 is formed in a portion of each of the grooves 22 about the peripheral edge 16 and through the wall 18. Each of the slits 24 extends completely through the wall 18 from the peripheral edge 16 down a predetermined distance in each groove 24. The area between adjacent grooves 22 and slits 24 form petals 26 of wall material 18. As shown in FIG. 2, a plurality of projections 28 extend into the cavity 20. The projections 28 are adjacent corresponding slits 24 and are formed in conjunction with the formation of the slits 24.

Referring again to FIGS. 1 and 2, the petals 26 are folded into the cavity 20 such that the end portion has a generally truncated cone shape. The petals 26 overlap and, with the projections 28, form a structure similar in appearance to a camera shutter when viewed from the vantage point of FIG. 2. As the slits 24 pass completely through the wall 18 and into the cavity 20, initial failure points for the petals 26 are formed at the slits 24, leading to uniform and consistent expansion upon impact with a target media. The initial failure points facilitate mushrooming of the petals 26 and enhance the performance of the bullet 10 at lower velocity levels. The grooves 22 further facilitate mushrooming of the petals 26, as they function as stress risers.

Figure 3:
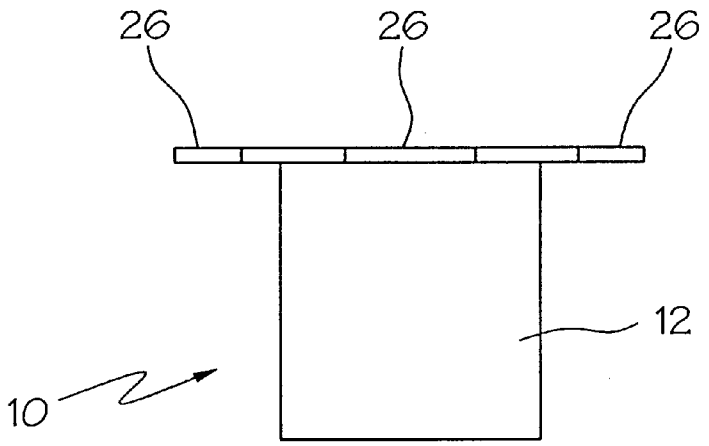
FIG. 3 is a side view of the hollow point bullet of FIG. 1 after impact with a target media.
Figure 4:
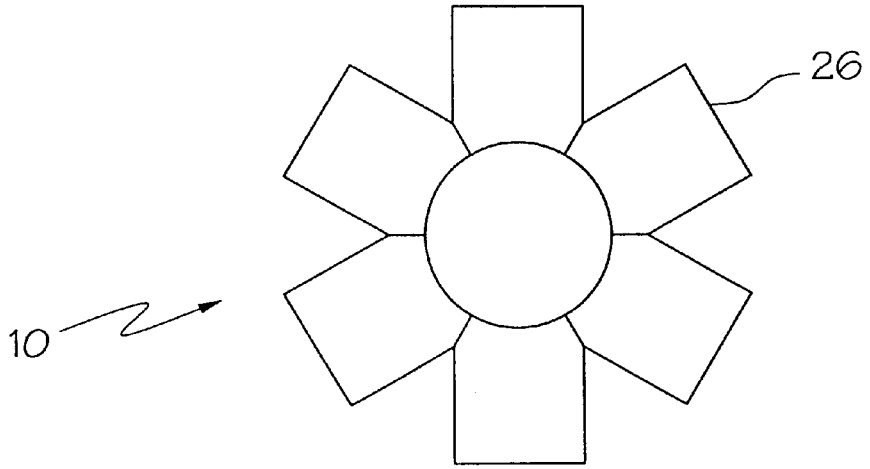
FIG. 4 is a plan view of the hollow point bullet of FIG. 1 after impact with a target media.

Referring now to FIGS. 3 and 4, upon impact with the target media, each of the petals 26 folds back away from the cavity 20, starting from the slits 24 and continuing relatively easily through the grooves 22. Mushrooming of the petals 26 increases the effective diameter of the bullet 10 to approximately twice its original diameter. The grooves 22 in conjunction with the slits 24 increase the mushrooming capabilities of the petals 26 and further enhance the performance of the bullet 10 at lower velocity levels.

In the illustrated embodiment, the cavity 20 has a truncated cone geometry. The thickness of the wall 18 increases from the peripheral edge 16 toward the base portion 12. The rate of change in the thickness of the wall 18 in this direction is non-linear, as the thickness changes at a non-constant rate. Accordingly, expansion of the end portion 14 of the bullet 10 upon impact with the target media is maximized, while over-expansion and curling under of the petals 26 is minimized. The internal geometry of the cavity 20 retards over expansion of the petals 26, since the increasing thickness of the wall 18 increases the structural integrity of both the wall 18 and the petals 26. This increased structural integrity reduces petal failure, and thus increases the performance and effectiveness of the bullet 10. It will be appreciated by those skilled in the art that the cavity 20 may have other internal geometries. It will be further appreciated by those skilled in the art that the rate of change in the thickness of the wall 18 may be linear or constant. The center of mass of the bullet 10 is closer to the base portion 12, thereby improving the dynamic and gyroscopic stability of the bullet 10.

The bullet 10 preferably is made of copper, either substantially pure or as a copper alloy. The copper alloy may comprise minor quantities of additional materials which do not alter the basic performance characteristics of the alloy. For example, the copper alloy may comprise up to about 35% zinc and up to about 3% of other materials, with the remainder being copper. The other materials may be selected from the group consisting of zirconium, magnesium, phosphorus, silver, beryllium, cobalt and iron. The following representative alloys, as identified by their Copper Development Association (CDA) alloy numbers, may be used:

| | | | | | |
|---|---|---|---|---|---|
| C10200 | C10400 | C10500 | C10700 | C11000 | C11300 |
| C11400 | C11600 | C12200 | C14500 | C14700 | C15000 |
| C15500 | C17200 | C17400 | C18200 | C19400 | C21000 |
| C22000 | C22600 | C23000 | C24000 | C26000 | C26800 |
| C27000 | | | | | |

Other copper alloys may also be used. In the illustrated embodiment, the bullet 10 may be made of a substantially oxygen free copper alloy, such as that commercially available as CDA#C10200.

The bullet 10 may be used in a muzzle loading firearm, a modern shotshell casing, handguns or rifles. The caliber of the bullet 10, of course, will be selected based on the particular application. The caliber of typical bullets for such applications range from about 0.35 to 0.50, with a sabot of 0.45, 0.50 or 0.54 or a shotshell of 0.410, 28, 20, 16, 12 or 10 gauge. The ballistic coefficient of the bullet 10 is in the range of about 0.19 to 0.21. When the bullet 10 is used in a shotshell casing, the bullet includes a ridge 30 between the base portion 12 and the end portion 14 which mates with a lip formed on the inside of the sabot (not shown) to form a mechanical interlock. It will be appreciated by those skilled in the art that an interlock may also be completed by having the sabot encompass a small portion of the end portion 14 thereby alleviating formation of the ridge 30.

Figure 5A:
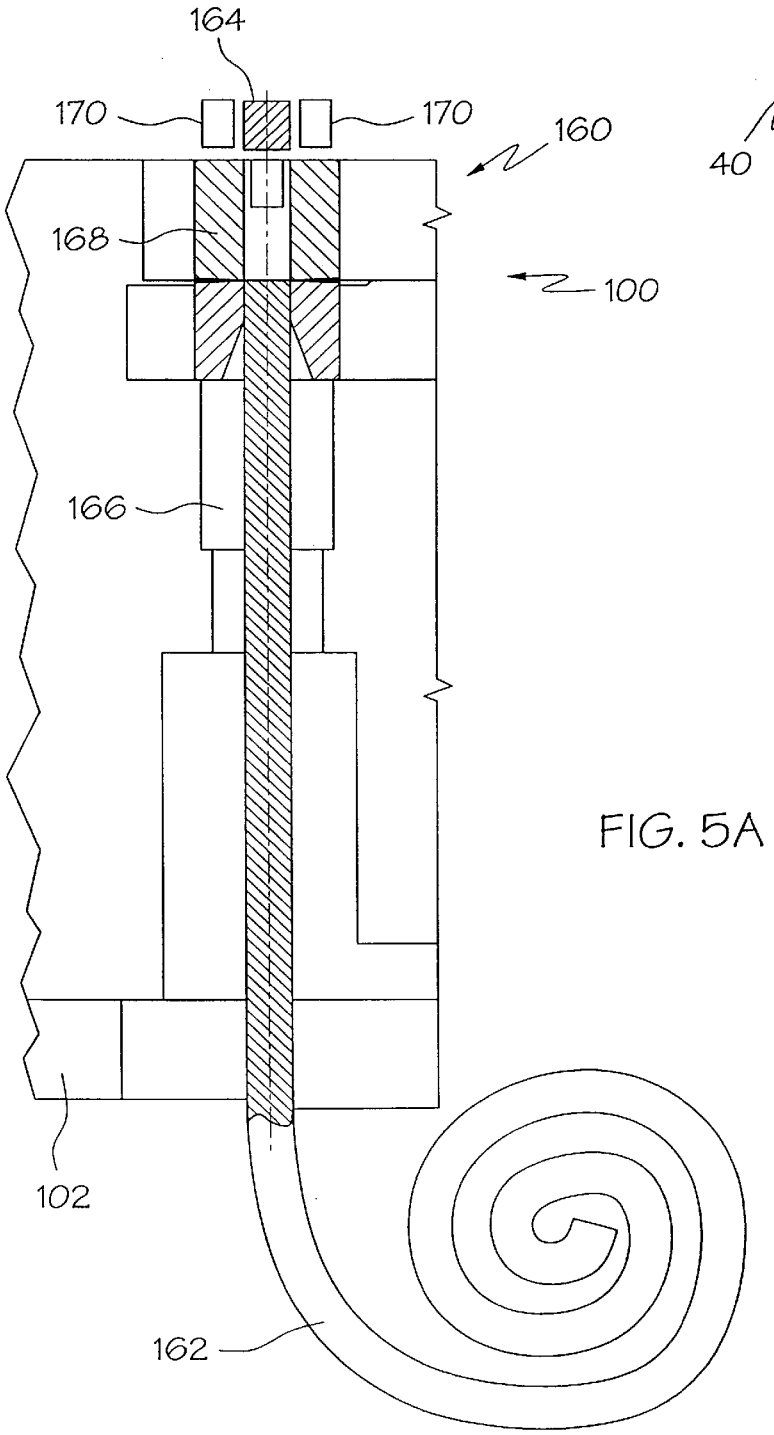
Figure 5B:
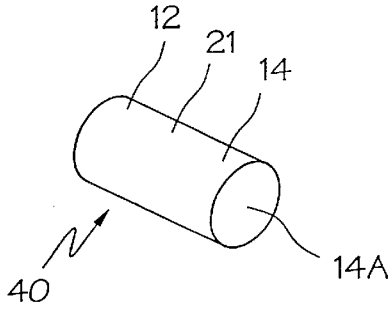

A method of manufacturing the bullet 10 will be described, with like reference numerals corresponding to like elements. Referring now to FIGS. 5A–10A, a press 100 is provided having a stationary bed portion 102 and a ram portion 104 which is caused to move back and forth relative to the bed portion 102 by a conventional drive apparatus (not shown). The bed and ram portions 102 and 104 include respectively first and second bullet forming tooling 106 and 108 which are provided at first, second, third, fourth and fifth forming stations 110, 120, 130, 140, and 150. Referring specifically to FIG. 5A, positioned adjacent to the first forming station 110 is a conventional cutting station 160. A roll of generally solid wire stock 162 having a predetermined diameter is fed to the cutting station 160 where it is cut into discrete, generally cylindrical slugs 164. The wire stock 162 is fed through a quill 166 and cut to a predetermined length by a cutter 168 thereby forming the slug 164, one of which is shown in FIG. 5B. The predetermined length and the predetermined diameter are set based on the desired size of the bullet 10. The slug 164 includes the outer surface 21, the base portion 12 and the end portion 14 terminating in an end face 14A. It will be appreciated by those skilled in the art that the slug 164 may be cast in the desired shape, length and diameter. Conventional work transfer fingers 170 (shown schematically in the drawings) move each of the discrete slugs 164 from the cutting station 160 to the first forming station 110 and from the first forming station 110 to the remaining forming stations 120, 130, 140 and 150.

Figure 6A:
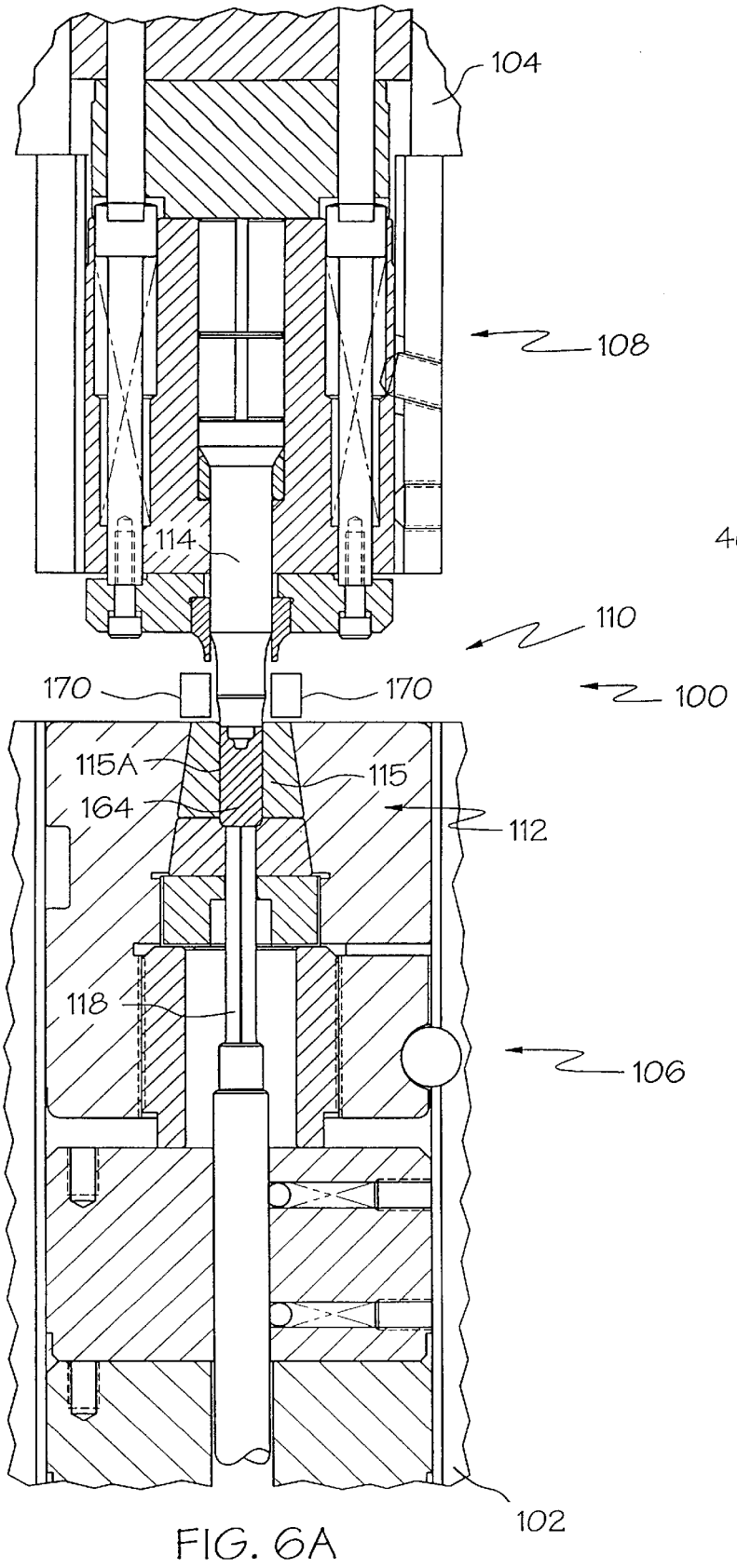
Figure 6B:
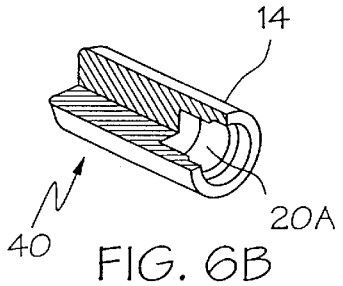

Referring now to FIG. 6A, the slug 164 is then transferred to the first forming station 110. The first forming station 110 includes a first forming die assembly 112 and a first forming punch 114. The first die assembly 112 includes a first forming die 115 which is fixedly coupled to the bed portion 102 and, hence, is stationary. The first die 115 includes an inner cavity 115A having an inner diameter substantially equal to the diameter of the slug 164. The first punch 114 is fixedly coupled to the ram portion 104 and moves with the same. In the illustrated embodiment, the first punch 114 comprises an extrusion punch. As the ram portion 104 is driven towards the bed portion 102, the first punch 114 engages the slug 164 and pushes the slug 164 into the first die 115. The first punch 114 is driven through the end face 14A of the slug 164 with an appropriate amount of force, while the slug 164 is securely held in the first die 115 to form a portion 20A of the cavity 20 through back extrusion. The first die assembly 112 includes an ejection pin 118 which ejects the slug 164 from the first die 115 and into the work transfer fingers 170 after the portion 20A of the cavity 20 is formed.

Figure 7A:
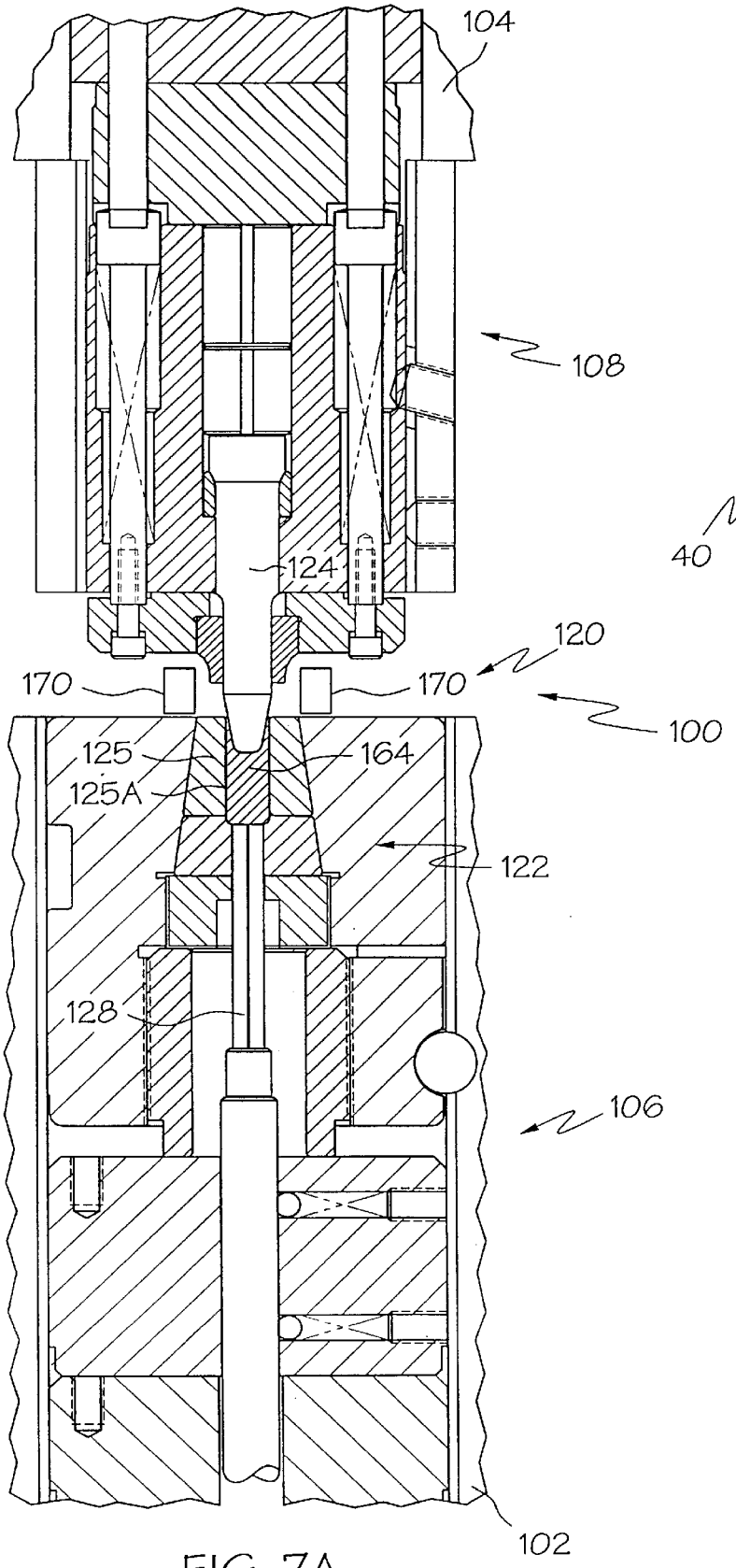
Figure 7B:
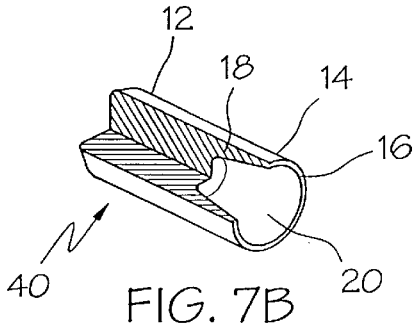

The slug 164 is then transferred to the second forming station 120 shown in FIG. 7A. The second forming station 120 includes a second forming die assembly 122 and a second forming punch 124. The second die assembly 122 includes a second forming die 125 which is fixedly coupled to the bed 102 and, hence, is stationary. The second die 125 includes an inner cavity 125A having an inner diameter substantially equal to the diameter of the slug 164. The second punch 124 is fixedly coupled to the ram portion 104 and moves with the same. In the illustrated embodiment, the second punch 124 comprises a tapered punch. As the ram portion 104 is driven towards the bed portion 102, the second punch 124 engages the slug 164 through the portion 20A of the cavity 20 and drives the slug 164 into the second die 125. The second punch 124 is driven into the portion 20A of the cavity 20 with an appropriate amount of force, while the slug 164 is securely held in the second die 125 to thereby form the cavity 20 in the desired shape. This process is also known as coining, since the cavity 20 is pressed between the second punch 124 and the second die 125 with the cavity 20 taking the shape of the second punch 125. The second punch 125 is shaped so that the cavity 20 has the desired truncated cone geometry shown in FIG. 7B. The combined operations of the first and second forming stations 110 and 120 form the cavity 20 so that the thickness of the wall 18 increases from the peripheral edge 16 of the end portion 14 towards the base portion 12. It will be appreciated by those skilled in the art that the cavity 20 may be formed in a single manufacturing step using an appropriate die and punch combination. The second forming die assembly 122 includes an ejection pin 128 which ejects the slug 164 from the second die 125 and into the work transfer fingers 170 once the cavity 20 is formed.

Figure 8A:
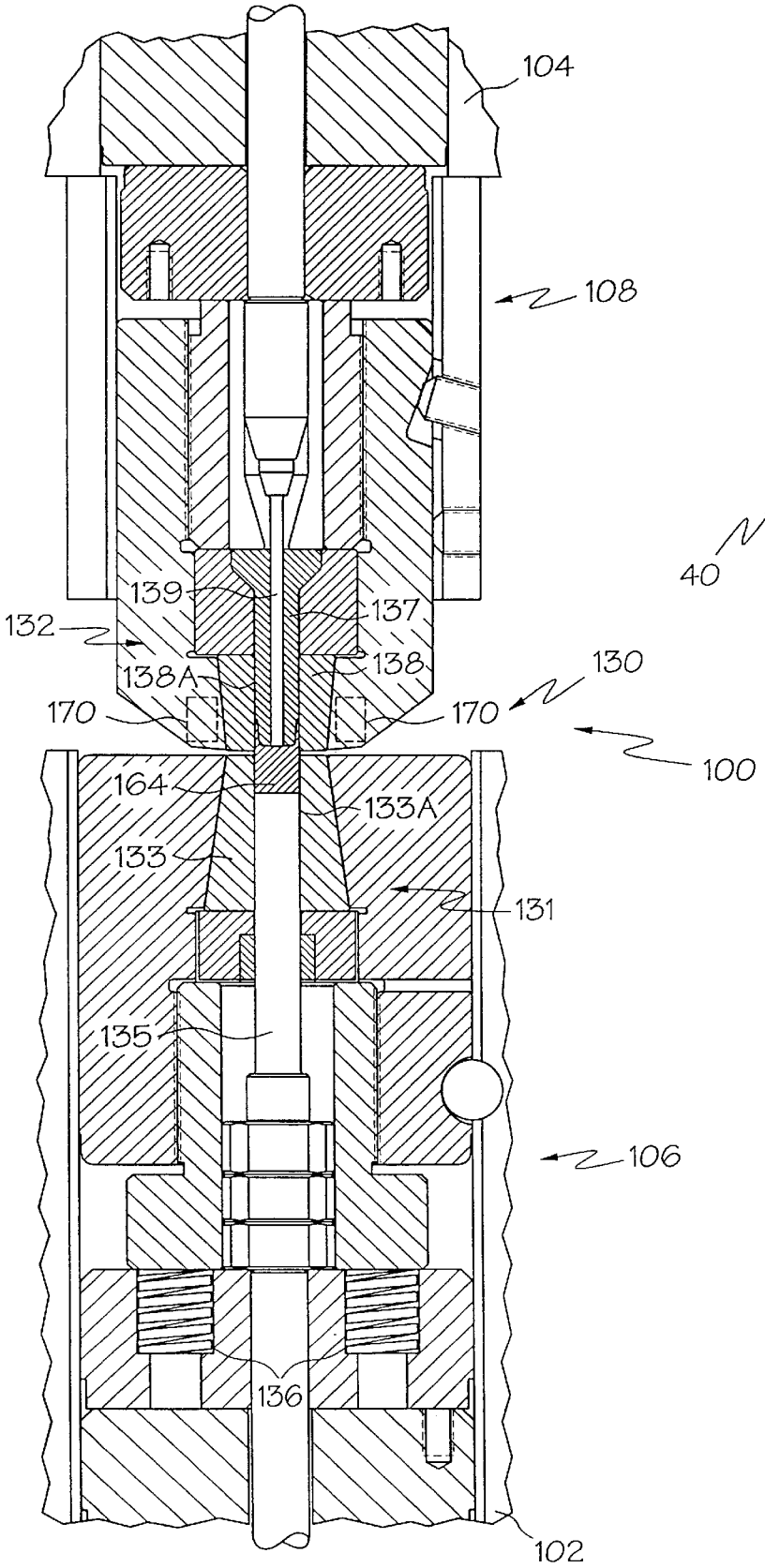

Once the cavity 20 is formed through the combined operations of the first and second forming stations 110 and 120, the slug 164 is transferred to the third forming station 130 shown in FIG. 8A. The third forming station 130 includes a third forming die assembly 131 and a third forming punch assembly 132. The third forming die assembly 131 includes a third forming die 133 which is slidably coupled to the bed portion 102. The third die 133 includes an inner cavity 133A and has an inner diameter sized for the desired diameter of the base portion 12 of the slug 164. The third die assembly 131 includes a third pressure/ejection pin 135 which is fixedly coupled to the bed portion 102 and extends through the inner cavity 134. The third die 133 slides about the third pressure/ejection pin 135 and is biased towards the ram portion 104 via a pair of springs 136. The third pressure/ejection pin 135 slides through the inner cavity 133A as the third die 133 is compressed with the springs 136 providing a counterbalancing force in the opposite direction.

Figure 8B:
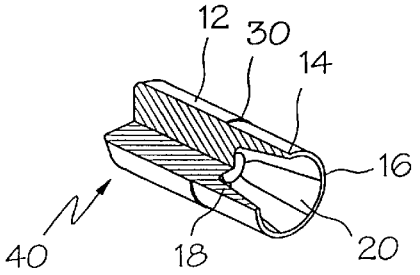

The third forming punch assembly 132 includes a third forming punch 137 and a third forming punch element 138. The third forming punch element 138 includes a punch cavity 138A through which the third forming punch 137 extends. The third forming punch 137 is sized to support the cavity 20 of the slug 164 while the third forming punch element 138 is sized to support the outer diameter of the end portion 14 of the slug 164. The third punch 137 and the third punch element 138 are fixedly coupled to the ram portion 104 and move with the same. As the ram portion 104 is moved towards the bed portion 102, the slug 164 is engaged by the third punch assembly 132 as the interior and exterior of the end portion 12 is supported by the third punch 137 and the third punch element 138. The slug 164 is then pushed into the third die 131 with the base portion 12 of the slug 164 engaging the third pressure/ejection pin 135. The third die 133 continues to slide about the third pressure/ejection pin 135 under the application of an appropriate amount of force from the third punch assembly 132. In other words, the third die 133 slides as the slug 164 remains stationary against the third pressure/ejection pin 135. This action increases the diameter of the base portion 12, thereby forming the ridge 30 between the base portion 12 and the end portion 14 as shown in FIG. 8B. In this manner, the base portion 12 of the slug 164 is upset as the diameter of the base portion 12 increases through the application of the appropriate amount of force from the third punch assembly 132. The third punch assembly 132 includes an ejection pin 139 which in conjunction with the third pressure/ejection pin 135 ejects the slug 164 from the third punch assembly 132 and the third die assembly 131, respectively, and into the work transfer fingers 170.

Figure 9A:
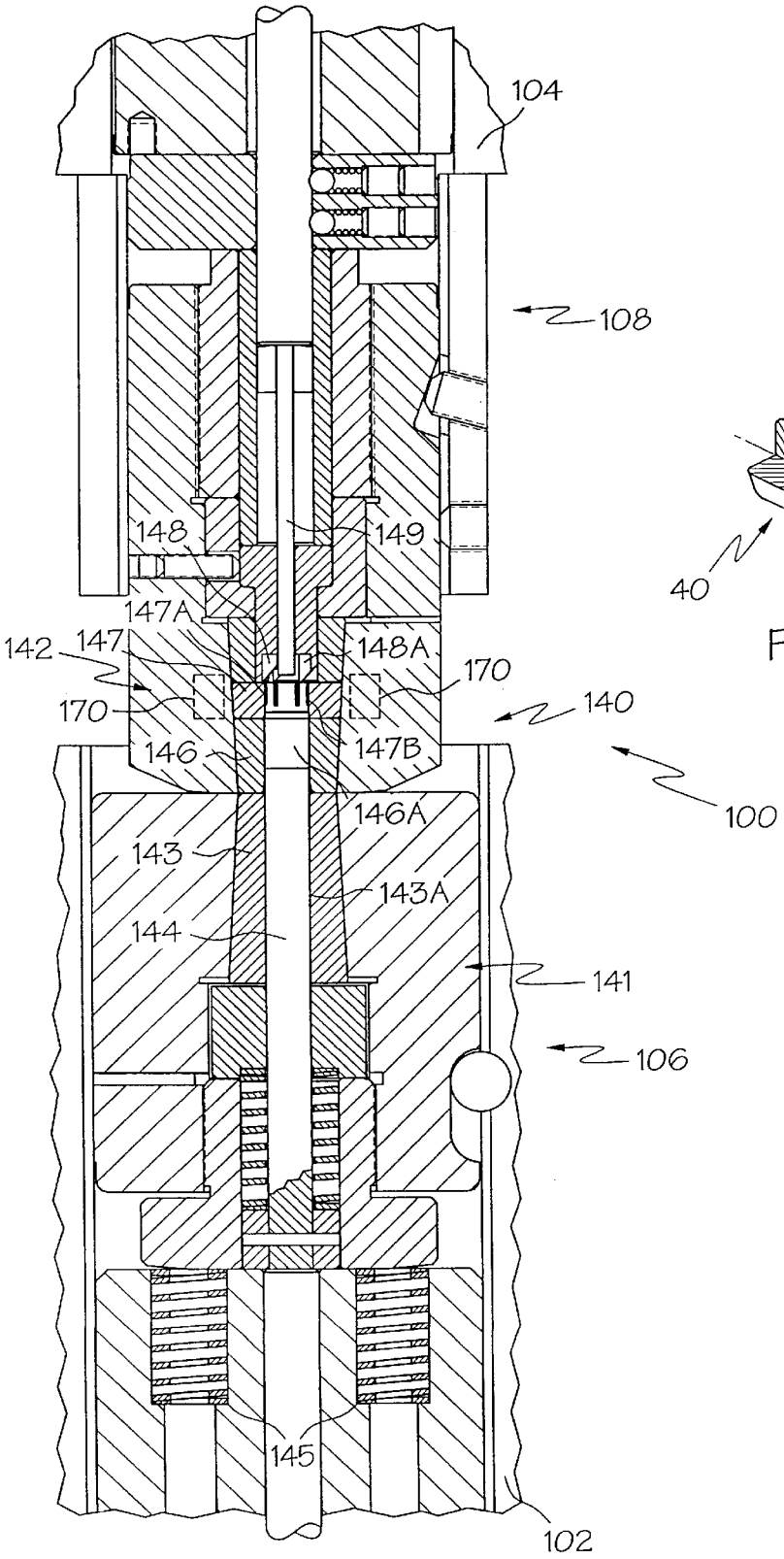

The slug 164 is then transferred to the fourth forming station 140 shown in FIG. 9A. The fourth forming station 140 comprises a fourth forming die assembly 141 and a fourth forming punch assembly 142. The fourth die assembly 141 includes a fourth forming die 143 which is slidably coupled to the bed portion 102. The fourth die 143 includes an inner cavity 143A having an inner diameter substantially equal to the diameter of the base portion 12 of the slug 164. The fourth die assembly 141 also includes a fourth pressure/ejection pin 144 which is fixedly coupled to the bed portion 102 and extends through the inner cavity 143A. The fourth forming die 143 slides about the fourth pressure/ejection pin 144 and is biased towards the ram portion 104 via a pair of springs 145. The fourth pressure/ejection pin 144 slides through the inner cavity 143A as the fourth die 141 is compressed with the springs 145 providing a counterbalancing force in the opposite direction.

Figure 9B:
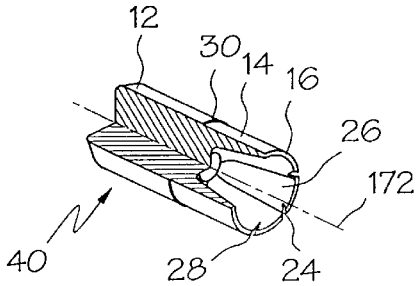

The fourth forming punch assembly 142 comprises a fourth punch member 146, a scoring element 147 and a cutting element 148. The fourth member 146, the scoring element 147 and the cutting element 148 are fixedly coupled to the ram portion 104 and move with the same. The fourth punch member 146 includes an inner cavity 146A having an inner diameter substantially equal to the diameter of the base portion 12 of the slug 164. The fourth punch member 146 is configured to support the slug 164 as it slides in the inner cavity 146A. The scoring element 147 includes a substantially cylindrical inner cavity 147A having a plurality of scoring fingers 147B (only one of which is shown in FIG. 9A) extending therein. The scoring fingers 147B are configured to form the grooves 22 as shown in FIG. 9B. In the illustrated embodiment, the scoring fingers 147B are spaced 60 degrees from each other to form six equally spaced grooves 22 and petals 28. It will be appreciated by those skilled in the art that the scoring fingers 147B may have any reasonable configuration to form the desired number of grooves 22 and in the desired configuration. As the ram portion 104 is moved towards the bed portion 102, the slug 164 is engaged by the fourth punch assembly 142 as the end portion 14 of the slug 164 is supported by the fourth punch member 146. The slug 164 is then pushed towards the fourth die assembly 141 with the base portion 12 of the slug 164 being engaged by the fourth pressure/ejection pin 144. The fourth die 143 continues to slide about the pressure/ejection pin 144 thereby forcing the slug 164 to slide through the fourth punch member 146 and into the scoring element 147. The grooves 22 are scored on the outer surface 21 of the slug 164 as it slides through the fourth punch member 146 and into the scoring element 147. The scoring fingers 147B are positioned so that the grooves 22 extend from the peripheral edge 16 down towards the base portion 12 a predetermined distance.

The cutting element 148 is positioned directly behind the scoring element 147 and includes a plurality of cutting fingers 148A. The cutting fingers 148A are configured to form the slits 24 in the corresponding grooves 22 as shown in FIG. 9B. The cutting fingers 148A are aligned with the scoring fingers 147B in the scoring element 147 so that slits 24 are cut into the grooves 22 and therefore are aligned with each other. Accordingly, in the illustrated embodiment, the cutting fingers 148A are spaced 60 degrees apart from each other and are aligned with the scoring fingers 147B in the scoring element 147. The slits 24 are cut completely through a portion of each groove 22 as further compression of the fourth die 141 causes the slug 164 to be pushed through the fourth punch member 146 and the scoring element 147 and into the cutting element 148. The cutting fingers 148A are configured so that the slits 24 are cut at a predetermined angle greater than zero degrees relative to a longitudinal axis 172 of the slug 164. This cutting operation forms the plurality of projections 28 which extend into the cavity 20. The projections 28 are triangular flaps which facilitate the folding of the petals 26 inwardly into the cavity 20 during formation of the bullet 10. It will be appreciated by those skilled in the art that the predetermined angle is dependent, in part, on the desired shape of the end portion 14 of the bullet 10. The fourth punch assembly 142 includes an ejection pin 149 which in conjunction with the fourth pressure/ejection pin 144 ejects the slug 164 from the fourth punch assembly 142 and the fourth die assembly 141, respectively, and into the work transfer fingers 170.

Figure 10A:
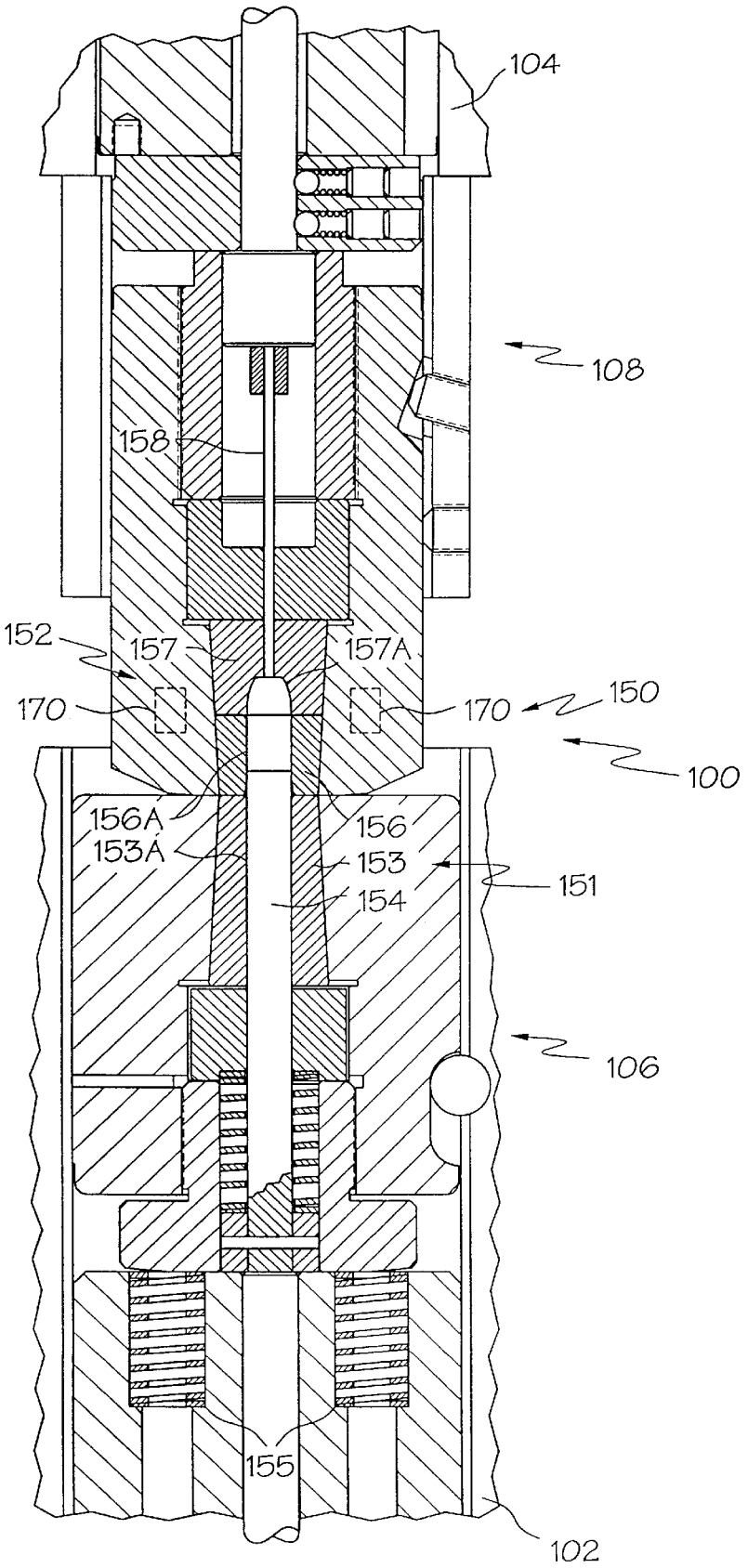

Once the grooves 22 and the slits 24 have been formed, the slug 164 transferred to the fifth forming station 150 shown in FIG. 10A. The fifth forming station 150 comprises a fifth forming die assembly 151 and a fifth forming punch assembly 152. The fifth die assembly 151 includes a fifth forming die 153 which is slidably coupled to the bed portion 102. The fifth die 153 includes an inner cavity 153A having an inner diameter substantially equal to the diameter of the base portion 12 of the slug 164. The fifth die assembly 151 also includes a fifth pressure/ejection pin 154 which is fixedly coupled to the bed portion 102 and extends through the inner cavity 153A. The fifth forming die 153 slides about the fifth pressure/ejection pin 154 and is biased towards the ram portion 104 via a pair of springs 155. The fifth pressure/ejection pin 154 slides through the inner cavity 153A as the fifth die 151 is compressed with the springs 155 providing a counterbalancing force in the opposite direction.

Figure 10B:
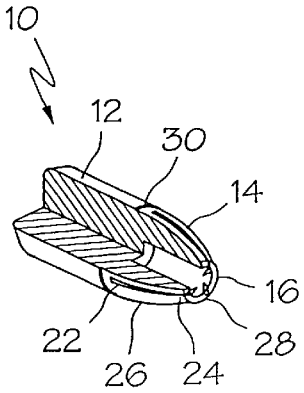

The fifth forming punch assembly 152 comprises a fifth punch member 156 and a sixth punch member 157. The fifth punch member 156 includes an inner cavity 156A having an inner diameter substantially equal to the desired diameter of the bullet 10. The fifth punch member 156 is configured to size and support the slug 164 as it slides in the inner cavity 156A. As the slug 164 is pushed through the inner cavity 156A of the fifth punch member 156, the base portion 12 will once again be sized or upset so that it has the desired diameter. The fifth punch member 157 includes a shaping cavity 157A which is shaped in the desired geometry for the end portion 14. In the illustrated embodiment, the shaping cavity 157A has a truncated cone geometry. As the ram portion 104 is moved towards the bed portion 102, the slug 164 is engaged by the fifth punch assembly 152 as the end portion 14 of the slug 164 is supported by the fifth punch member 156. The slug 164 is then pushed towards the fifth die assembly 151 with the base portion 12 of the slug 164 being engaged by the fifth pressure/ejection pin 154. The fifth die 153 continues to slide about the fifth pressure/ejection pin 154 thereby forcing the slug 164 to slide through the fifth punch element 156 and into the fifth punch element 157. The end portion 14 is contoured or coined as an appropriate amount of force causes the petals 26 to curl inwards into the cavity 20 while the base portion 12 is properly sized. Once this operation is complete, the end portion 14 has the desired shape and geometry and the slug 164 becomes the bullet 10 as shown in FIG. 10B. The fifth punch assembly 152 includes an ejection pin 158 which in conjunction with the fifth pressure/ejection pin 154 ejects the bullet 10 from the fifth punch assembly 152 and the fifth die assembly 151, respectively, and into the work transfer fingers 170. The bullet 10 is then deposited into a storage container (not shown).

Once the bullet 10 is formed, the copper may be soften by annealing the bullet 10 for an appropriate period of time at an appropriate temperature. The annealing process can be used to adjust the hardness of the copper material, thereby providing a method for modifying the expansion characteristics of the bullet 10 by adjusting the metallurgic properties of the copper material. In the illustrated embodiment, the bullet 10 may typically be annealed at 900° F. for one hour in a nitrogen and hydrogen atmosphere. The bullet 10 may include a more efficient ogive section and a boatail for enhanced aerodynamic performance.

Having described the invention in detail and by reference to preferred embodiments thereof, it will be apparent that modifications and variations are possible without departing from the scope of the invention defined in the appended claims.

What is claimed is:

1. A method of manufacturing a bullet comprising:

providing a slug of generally solid material having an outer surface and an end portion, said end portion having a cavity therein;

forming a plurality of grooves on said outer surface of said end portion;

forming one of a plurality of slits through at least a portion of each of said plurality of grooves; and contouring said end portion of said slug so that said bullet has a predetermined shape; wherein said step of forming one of a plurality of slits through at least a portion of each of said plurality of grooves comprises the step of forming one of a plurality of projections extending into said cavity substantially adjacent corresponding ones of said slits.

2. The method of claim 1, wherein said step of forming a plurality of grooves on said outer surface of said end portion and said step of forming one of a plurality of slits through at least a portion of each of said plurality of grooves are performed substantially simultaneously.

3. The method of claim 1, wherein said end portion includes a peripheral edge about which each of said slits are formed.

4. The method of claim 1, wherein each of said slits are formed at an angle of a predetermined number of degrees with respect to a longitudinal axis of said slug thereby forming each of said projections, said predetermined angle being greater than zero degrees.

5. The method of claim 1, wherein said cavity in said end portion has a truncated cone geometry.

6. The method of claim 1, wherein said step of providing a slug of generally solid material having an outer surface and an end portion comprises forming said cavity in said end portion through an end face thereof.

7. The method of claim 6, wherein said step of forming said cavity in said end portion through an end face thereof comprises:

forming a portion of said cavity in said end portion in a first forming station; and shaping said portion of said cavity in a second forming station to form a truncated cone geometry in said end portion.

8. The method of claim 7, wherein said slug comprises a base portion substantially adjacent said end portion and further comprising the step of increasing a diameter of said base portion in a third forming station thereby forming a ridge on said outer surface between said base portion and said end portion.

9. The method of claim 1, wherein each of said plurality of grooves are formed simultaneously.

10. The method of claim 1, further comprising the step of annealing said slug.

11. A method of manufacturing a bullet comprising the steps of:

providing a roll of generally solid wire stock;

cutting said roll of wire stock to a predetermined length, thereby to form a slug having an outer surface, a base portion and an end portion terminating in an end face;

forming a cavity in said end portion of said slug through said end face, said cavity forming a peripheral edge along said end face;

forming a plurality of grooves on said outer surface of said slug extending from said peripheral edge towards said base portion a predetermined distance;

forming one of a plurality of slits through at least a portion of each of said plurality of grooves along said peripheral edge; and contouring said end portion of said slug so that said bullet has a predetermined shape; wherein said step of forming one of a plurality of slits through at least a portion of each of said plurality of grooves along said peripheral edge comprises the step of forming one of a plurality of projections extending into said cavity substantially adjacent corresponding ones of said slits.

12. The method of claim 11, wherein said step of forming a plurality of grooves on said outer surface of said slug extending from a lower portion of said end portion and terminating at said peripheral edge and said step of forming one of a plurality of slits through at least a portion of each of said plurality of grooves along said peripheral edge are performed substantially simultaneously.

13. The method of claim 11, wherein each of said slits are formed at an angle of a predetermined number of degrees with respect to a longitudinal axis of said slug thereby forming each of said projections, said predetermined angle being greater than zero degrees.

14. The method of claim 11, wherein said cavity in said end portion has a truncated cone geometry.

15. The method of claim 11, further comprising the step of increasing a diameter of said base portion thereby forming a ridge on said outer surface between said base portion and said end portion.

16. The method of claim 11, wherein each of said plurality of grooves are formed simultaneously.

17. A method of manufacturing a bullet comprising:

providing a roll of generally solid wire stock;

cutting said roll of wire stock to a predetermined length to thereby form a slug having an outer surface, a base portion and an end portion terminating in an end face;

forming a portion of a cavity in said end portion through said end face in a first forming station, said cavity forming a peripheral edge along said end face;

shaping said portion of cavity in a second forming station such that said cavity has truncated cone shape in said end portion;

increasing a diameter of said base portion in a third forming station thereby forming a ridge on said outer surface between said base portion and said end portion;

forming a plurality of grooves on said outer surface of said slug extending from said peripheral edge towards said base portion a predetermined distance in a fourth forming station;

forming one of a plurality of slits through at least a portion of each of said plurality of grooves along said peripheral edge in said fourth forming station; and contouring said end portion of said slug so that said bullet has a predetermined shape in a fifth forming station; wherein said step of forming one of a plurality of slits through at least a portion of each of said plurality of grooves along said peripheral edge comprises the step of forming one of a plurality of projections extending into said cavity substantially adjacent corresponding ones of said slits.

18. The process of claim 17, wherein each of said plurality of grooves are formed simultaneously by scoring said outer surface of said slug against a scoring element having a plurality of scoring fingers corresponding to each of said plurality of grooves.

19. The process of claim 18, wherein each of said slits are formed simultaneously by cutting said end portion of said slug using a cutting element positioned substantially adjacent said scoring element and having a plurality of cutting fingers aligned with each of said scoring fingers of said scoring element.

20. A method of manufacturing a copper bullet comprising:

providing a slug of generally solid copper material having an outer surface and an end portion, said end portion having a cavity therein;

forming a plurality of grooves on said outer surface of said end portion;

forming one of a plurality of slits through at least a portion of each of said plurality of grooves; and contouring said end portion of said slug so that said bullet has a predetermined shape;

wherein said step of forming a plurality of grooves on said outer surface of said end portion and said step of forming one of a plurality of slits through at least a portion of each of said plurality of grooves are performed substantially simultaneously; and said step of forming one of a plurality of slits through at least a portion of each of said plurality of grooves comprises the step of forming one of a plurality of projections extending into said cavity substantially adjacent corresponding ones of said slits.

* * * * *